United States Patent [19]

Schumacher

[11] 4,003,214

[45] Jan. 18, 1977

[54] AUTOMATIC ICE MAKER UTILIZING HEAT PIPE

[75] Inventor: Frank A. Schumacher, Louisville, Ky.

[73] Assignee: General Electric Company, Louisville, Ky.

[22] Filed: Dec. 31, 1975

[21] Appl. No.: 645,627

[52] U.S. Cl. ..... 62/340; 62/333; 62/383; 165/105

[51] Int. Cl.[2] ..... F25C 1/08

[58] Field of Search ..... 62/340, 333, 383, 233; 165/105

[56] References Cited

UNITED STATES PATENTS

| | | | |
|---|---|---|---|
| 1,711,804 | 5/1929 | Munters | 165/105 X |
| 2,718,123 | 9/1955 | Braswell, Jr. | 62/106 |
| 3,517,730 | 6/1970 | Wyatt | 62/383 X |
| 3,538,720 | 11/1970 | Feola | 62/352 |
| 3,803,871 | 4/1974 | Karas | 62/348 |
| 3,884,293 | 5/1975 | Pessolano et al. | 165/105 X |
| 3,933,198 | 1/1976 | Hara et al. | 165/105 X |

*Primary Examiner*—William F. O'Dea
*Assistant Examiner*—William E. Tapolcai, Jr.
*Attorney, Agent, or Firm*—Steven C. Schnedler; Francis H. Boos

[57] ABSTRACT

An automatic ice maker includes a heat pipe in the form of a sealed tube containing a refrigerant which extends from the freezer compartment to the fresh food compartment of a household refrigerator. Positioned within the heat pipe and located intermediate the freezer and fresh food compartment is a valve preferably in the form of a steel ball which is periodically unseated from an annular valve seat by a rotating magnet actuator mechanism. The portion of the heat pipe within the fresh food compartment is positioned within a water reservoir and is also insulated but for an ice-making surface thereof. When the check valve of the heat pipe is open, heat transfer thereto to the freezer compartment is enhanced to cause a clear ice cube to be formed on the uninsulated ice-making surface of the submersed heat pipe. When the check valve closes, the heat of the surrounding water will harvest the ice cube by releasing same to float to the top of the reservoir for collection and storage by conventional means.

10 Claims, 2 Drawing Figures

AUTOMATIC ICE MAKER UTILIZING HEAT PIPE

BACKGROUND OF THE INVENTION

1. Field of the Invention

The present invention is related to ice makers and, more particularly, is directed to an automatic ice maker of the type which is intended for use in household refrigerators.

2. Description of the Prior Art

Commercially available automatic ice makers for household refrigerators are generally complex mechanisms which sometimes require require their own refrigeration system as well as ice formation and harvesting systems. As a result, such ice makers are relatively expensive, unduly complex, difficult to service and use, and are generally inefficient to operate.

Further, although it is generally accepted that the average consumer would prefer clear ice cubes over impurity-clouded ice cubes, ice makers which are designed to provide ice cubes of the clear variety are generally even more complex than an ordinary ice maker, and are therefore uneconomical and not in wide use.

Some of the more pertinent prior art patents uncovered during the course of a novelty search of the present invention include: U.S. Pat. Nos. 2,718,123; 3,538,720; 3,803,871; and 3,884,293.

The Braswell, Jr. patent U.S. Pat. No. 2,718,123 illustrates an ice making machine wherein a plurality of clear ice particles 12 are formed within a tank 10 that contains water. Surrounding tank 10 are a plurality of circumferentially spaced combined freezing and melting tubular elements 17 which are inwardly bent so as to form a plurality of contact points 18 with the wall of tank 10. Cold and hot liquid refrigerants are alternatively passed through each of the tubular elements 17 so as to successively and alternatively form and harvest the ice chips 12 at the points of contact 19 with element 17. The form-harvest cycle is regulated by a master valve 30 which includes a slowly rotating valve disc 33. A check valve apparatus 54 assists in controlling the passage of the hot and cold liquid refrigerants into the individual tubular elements 17.

While desirable from the viewpoint of providing clear ice cubes, the Braswell, Jr. apparatus is nevertheless believed unduly complex and prone to mechanical infirmities.

The Feola and Karas patents (U.S. Pat. Nos. 3,538,720 and 3,803,871) illustrate other typical prior art automatic ice cube makers. None of the foregoing patents, however, is believed to approach the structural simplicity and concommitant cost savings of the instant invention, as will be more clear hereinafter.

OBJECTS AND SUMMARY OF THE INVENTION

It is therefore a primary object of the present invention to provide an automatic ice maker for a household refrigerator which is inexpensive to manufacture, easy to install and maintain, and which provides clear ice cubes automatically and efficiently.

Another object of the present invention is to provide an automatic ice making apparatus for installation in a household refrigerator's freezer compartment and fresh food compartment which provides harvested clear ice cubes in the fresh food compartment as desired.

An additional object of the present invention is to provide a simplified automatic ice maker for a household refrigeration apparatus which is non-complex, has a minimum of parts, may be easily installed, and which utilizes the well-known heat transfer properties of heat pipes.

A still further object of the present invention is to provide a valved, automatic ice making apparatus which periodically forms and harvests clear ice cubes within a water/ice reservoir positioned within the fresh food compartment of a household refrigerator.

The foregoing and other objects are attained in accordance with one aspect of the present invention through the provision of an automatic ice maker for use in a refrigeration apparartus which includes a first compartment maintained at below-freezing temperature and a second compartment maintained at above-freezing temperature, which may respectively comprise the frozen and fresh food compartments of a household refrigerator. The automatic ice maker comprises conduit means extending between and having portions positioned within the first and second compartments, means for providing water adjacent the portion of the conduit means positioned within the second compartment, and control means positioned within the conduit means for alternatively permitting and preventing heat transfer between the portions of the conduit means positioned within the first and second compartments. Insulating means is positioned about substantially all of the portion of the conduit means which is positioned within the second compartment, with the exception of a small ice-forming portion thereof which is uninsulated from the surrounding water.

In accordance with still other aspects of the present invention, the heat transfer control means comprises a check valve apparatus preferably in the form of a steel ball normally positioned within an annular valve seat. The valve seat comprises an inwardly extending circumferentially formed lip positioned within the conduit means at a portion there of intermediate the frozen and fresh food compartments of the refrigerator. A periodic actuator is positioned externally of the conduit means and is adjacent the location of the valve seat. The actuator comprises a rotatable wheel having a plurality of magnets positioned at spaced intervals along a concentric path, such as the periphery, thereof. The rotatable actuator wheel periodically moves the steel ball from its position in the valve seat to an open position for a predetermined period of time which corresponds to the time necessary for the formation of an ice button or cube on the uninsulated portion of the conduit means immersed in the water reservoir. When the valve closes, heat transfer is inhibited so as to warm the lower portion of the conduit means to release the ice button from the uninsulated portion thereof. The ice button then floats to the top of the reservoir and is collected and stored by conventional means.

In accordance with still further aspects of the present invention, the conduit means preferably comprises an elongated tube having a condensable refrigerant sealed therein, which is referred to in the art as a heat pipe. The upper portion of the heat pipe which extends within the freezer compartment may also be provided with a plurality of fins laterally spaced about the periphery thereof for assisting in the transfer of the heat therefrom to the freezer compartment when the check valve is open. The time of ice formation and harvesting may be regulated by controlling the speed of rotation of the actuator wheel.

BRIEF DESCRIPTION OF THE DRAWINGS

Various objects, features, aspects and attendant advantages of the present invention will be more fully appreciated as the same becomes better understood when considered in light of the following detailed description of the present invention viewed in conjunction with the accompanying drawings, in which.

DETAILED DESCRIPTION OF THE PREFERRED EMBODIMENTS

Figure 1:
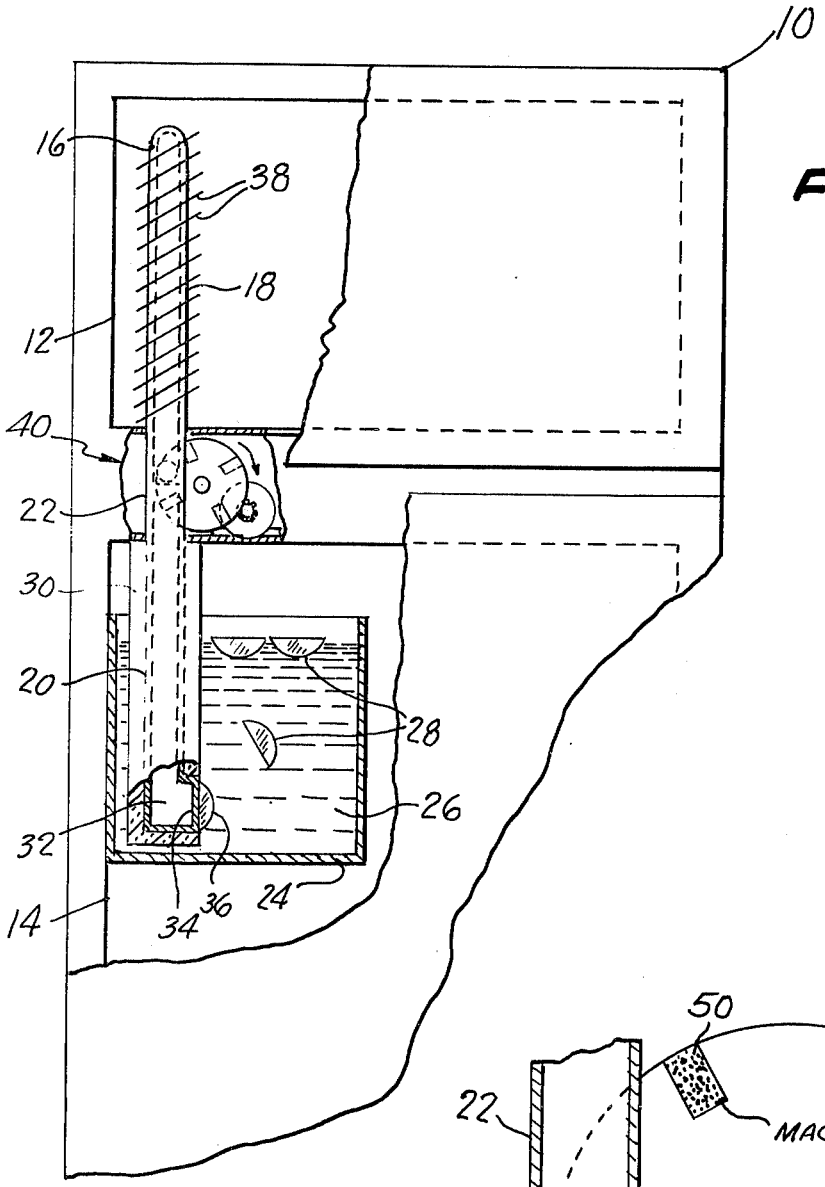
FIG. 1 is a schematic front view, partially broken away and in partial section, illustrating a household refrigerator equipped with an ice making device according to a preferred embodiment of the present invention.

Referring now to the drawings, wherein like reference numerals designate identical or corresponding parts throughout the several views, and more particularly to FIG. 1 thereof, reference numeral 10 indicates generally an ordinary household refrigerator which includes a fresh food compartment 14 disposed under the freezer compartment 12.

As will become readily apparent, the ice maker of the present invention, while described hereinafter in connection with an ordinary household refrigerator having a freezer compartment and a fresh food compartment, is nevertheless adaptable to any refrigeration system which includes a first compartment maintained at below-freezing temperatures and a second compartment maintained at above-freezing temperatures.

Connecting the freezer compartment 12 and the fresh food compartment 14 of the refrigerator 10 is a vertically disposed, elongated tubular conduit 16 having a refrigerant charge 32 sealed therein. Elongated sealed tube 16 is commonly referred to in the art as a heat pipe.

As is known, a heat pipe is a closed environment containing a fluid which constantly undergoes an evaporative/condensation cycle. Within the closed environment, such as sealed tube 16, gravitational forces transfer condensed fluid from the cold upper portion or condenser to the hot lower portion or evaporator where the fluid returns to the vapor state. The vapor then moves up through the closed environment to the condenser where it returns to the fluid state. The cycle is then repeated.

In FIG. 1, the refrigerant charge 32 is transformed to its vapor state in the lower or evaporator portion 20 of heat pipe 16. The upper or condenser portion 18 of heat pipe 16, positioned within freezer compartment 12, is the portion of heat pipe 16 where the refrigerant 32 returns to the fluid state, after which it returns, aided by gravity, to the evaporator portion 20.

It therefore may be appreciated that a heat pipe is of extreme structural simplicity, being basically comprised of only two parts: the sealed tubular container 16 and the fluid (refrigerant 32). Heat pipes are desirable devices as a result of their high efficiency of operation which substantially enhances the heat transfer capability of a given mass of fluid, all of which is well known in the art and therefore need not be documented in detail herein.

A heat pipe 16 suitable for use in conjunction with the preferred embodiment of the present invention preferably comprises a small bore (⅜ inch) closed tube having thin walls and charged with any suitable condensable gas, such as R-12. The upper condenser portion 18 of heat pipe may include a plurality of cooling fins 38 positioned thereabout to assist heat transfer from the walls of the pipe to the surrounding freezer compartment 12. Use of fins 38 would be most desirable and efficient in a forced air refrigerator wherein the air would be forced through the fins. Alternatively, the upper portion 18 of heat pipe 16 could be thermally attached to the inner wall of freezer 12 by suitable thermal transfer plates and mastic.

The lower or evaporator portion 20 of heat pipe 16 extends into an ice and water reservoir 24 also positioned in the fresh food compartment 14 of refrigerator 10. Reservoir 24 is preferably one-half to three-quarters filled with water 26 from a continuously replenishable source of supply (not shown).

Disposed about a major part of the lower portion 20 of heat pipe 16 is insulation 30 which covers lower portion 20 except for a relatively small "exposed" ice-forming surface 34 thereof. It should be understood that while the present embodiment illustrates only a single ice-forming surface 34, numerous other configurations are possible which include a plurality of such surfaces and are clearly within the scope of the present invention.

Figure 2:
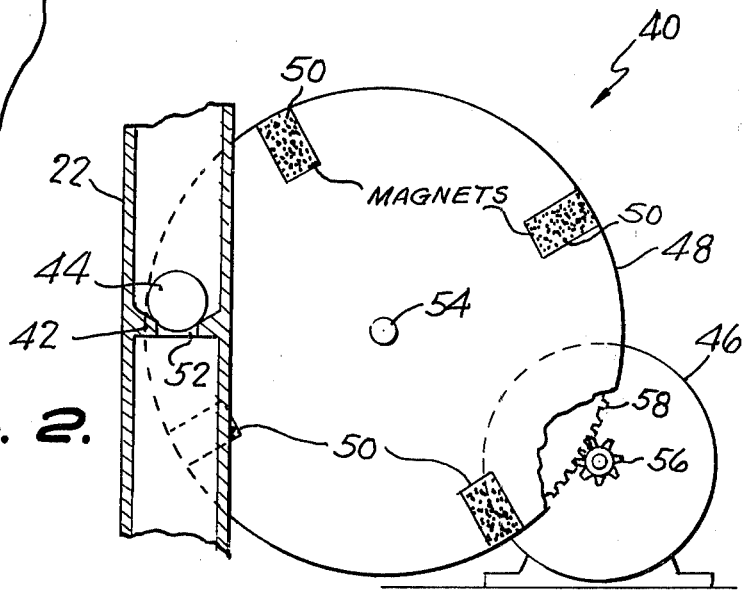
FIG. 2 is an enlarged view of a portion of the preferred embodiment illustrated in FIG. 1, and more particularly illustrates in some detail a preferred embodiment of a periodic actuator element for controlling the ice formation and harvesting cycle of the automatic ice maker in accordance with the teachings of the present invention.

Disposed intermediate the upper condenser portion 18 and lower evaporator portion 20 of heat pipe 16 is a valve assembly indicated generally in FIG. 1 by the reference numeral 40. Valve assembly 40 is illustrated in more detail in FIG. 2, to which attention is now directed, and includes a substantially circular inwardly extending lip 42 formed on the inside surface of the intermediate portion 22 of heat pipe 16 so as to form a through aperture 52. A metallic, preferably steel, ball 44 serves as a check for a valve seat 42 and is adapted to be sealingly seated on seat 42 under the influence of gravity.

Actuation and control of the check valve apparatus is achieved by means of a valve actuator wheel 48 having an axis of rotation 54. Wheel 48 includes a step-down gear 58 formed on the periphery thereof which meshes with a pinion gear 56 connected with the shaft of a motor 46. Actuation of motor 46 will, in turn, rotate wheel 48 in a clockwise direction about axis 54.

Disposed about the periphery of valve actuator wheel 48 are a plurality of permanent magnets 50. It may appreciated that the magnets 50, while illustrated along the extreme outer periphery of wheel 48, may alternatively be positioned inwardly of the outer periphery of wheel 48 as convenience and other design criteria dictate.

As can be appreciated, rotation of wheel 48 causes each of the magnets 50 to individually pass adjacent the position of steel ball 44 and valve seat 42. The magnets 50 attract the steel ball 44 off valve seat 42 for a predetermined period of time until each of the magnets 50 are rotated sufficiently such that their respective magnetic fields individually release ball 44 back onto its valve seat 42.

In operation, as motor 46 is actuated to rotate valve actuator wheel 48, the ball-seat valve 42–44 alternately opens and closes aperture 52. When aperture 52 is unobstructed by virtue of the coaction of a magnet 50 with steel ball 44, the heat of the lower portion 20 of heat pipe 16 will be transferred to the upper portion 18 positioned within the freezer compartment 12. This heat transfer will cause clear ice cubes or buttons to be formed on all uninsulated portions of the lower evaporator portion 20 of heat pipe 16, such as surface 34. The ice pieces formed will be clear as a result of their being frozen while submerged in water 26.

When magnet 50 releases ball 44 to close aperture 52, all refrigeration of the lower evaporator portion 20 of heat pipe 16 will cease. The above-freezing temperature from the water 26 contained within reservoir 24 will warm the lower evaporator portion 20 of heat pipe 16 such that the submerged clear ice button 36 just formed will melt free from the ice-forming surface 34. The freed ice button will float to the surface of the water 26 in reservoir 24, as illustrated by previously formed ice buttons 28.

The clear ice pieces 28 after accumulating may be scooped from the container 24 for later storage and use by various well-known mechanisms (not illustrated). A conventional float valve may arrange for the admission of additional water to reservoir 24 as necessary.

Further, a mechanical link may be provided from motor 46 to reservoir 24 to detect the depth of formed ice pieces to shut motor 46 off (electrically or mechanically) when sufficient ice cubes are collected, and when steel ball 44 is firmly seated in valve seat 42 to prevent further ice formation.

While heat pipe 16 is shown positioned substantially vertically, other configurations are possible so long as the condensed fluid in the upper portion of heat pipe 16 is not prevented from flowing back to the evaporator portion therebelow. In cases where tubing configuration prevents gravitational flow of condensed fluid, it is recognized in the heat pipe art that internal wicks may be employed to transfer liquid in a direction countering gravitational flow. However this is not necessary when the refrigeration source is elevated above the water reservoir, as in the illustrated embodiment.

While presently available state of the art heat pipes may require an ice formation-harvesting cycle of approximately 15 to 30 minutes, it is anticipated that improved materials and techniques will enable the formation of a half-dollar sized ice button with a small crown in approximately ten minutes.

It is seen that the present invention provides an improved, simple and inexpensive ice making apparatus which is based on the known technology of heat pipes and has as a side benefit the formation of inherently clear ice cubes or buttons.

Obviously, numerous modifications and variations of the present invention are possible in light of the above teachings. It is therefore to be understood that within the scope of the appended claims, the invention may be practiced otherwise than as specifically described herein.

I claim as my invention:

1. In a refrigeration apparatus which includes a first compartment maintained at below-freezing temperatures and a second compartment maintained at above-freezing temperatures, an automatic ice maker which comprises:

conduit means extending between and having portions positioned within said first and second compartments;

means for providing water adjacent the portion of said conduit means positioned within said second compartment; and means positioned within said conduit means for alternately permitting and preventing heat transfer between said portions of said conduit means positioned within said first and second compartments.

2. The automatic ice maker as set forth in claim 1, which further comprises insulating means positioned about substantially all of said portion of said conduit means positioned within said second compartment, a small ice-forming portion thereof being uninsulated from said water.

3. The automatic ice maker as set forth in claim 1, wherein the portion of said conduit means positioned within said first compartment further includes means for assisting in the transfer of heat therefrom to said first compartment.

4. The automatic ice maker as set forth in claim 3, wherein said heat transfer assisting means comprises a plurality of fins laterally spaced about the periphery of said portion of said conduit means positioned within said first compartment.

5. The automatic ice maker as set forth in claim 1, wherein said means positioned within said conduit means for alternately permitting and preventing heat transfer comprises ball check valve means which includes a ball check, and a valve seat comprising an inwardly extending circumferentially formed lip positioned within said conduit means at a portion thereof intermediate said first and second compartments, and wherein said ice maker further comprises periodic actuator means for alternately opening and closing said ball check valve means.

6. The automatic ice maker as set forth in claim 5, wherein said periodic actuator means comprises a rotatable actuator wheel positioned externally of said conduit means and adjacent said valve seat, said actuator wheel having a plurality of magnetic actuator means positioned at spaced intervals about a concentric path thereon, whereby said ball check is adapted to be moved from its valve closed position in said valve seat by said magnetic actuator means for a predetermined period of time necessary for ice formation.

7. The automatic ice maker as set forth in claim 1, wherein said conduit means comprises a heat pipe.

8. The automatic ice maker as set forth in claim 1, wherein said conduit means comprises an elongate sealed tube having a condensable refrigerant located therein.

9. The automatic ice maker as set forth in claim 8, further comprising means located in said second compartment for containing a reservoir of water, and wherein the portion of said sealed tube which is positioned within said second compartment has insulation wrapped about all but an ice forming surface thereof, said ice forming surface being positioned within said reservoir of water.

10. The automatic ice maker as set forth in claim 9, wherein said means positioned within said elongate sealed tube for alternately permitting and preventing heat transfer comprises ball check valve means which includes a ball check, and a valve seat comprising an inwardly extending circumferentially formed lip positioned within said elongate sealed tube at a portion thereof intermediate said first and second compartments, and wherein said ice maker further comprises periodic actuator means including a rotatable actuator wheel positioned externally of said sealed tube and adjacent said valve seat, said actuator wheel having a plurality of magnetic actuator means positioned at spaced intervals about a concentric path thereon, whereby said ball check is movable from said valve seat by said magnetic actuator means so as to enhance heat transfer between said compartments for a predetermined period of time necessary for ice formation.

* * * * *